US008845374B2

(12) United States Patent
Higgins et al.

(10) Patent No.: US 8,845,374 B2
(45) Date of Patent: Sep. 30, 2014

(54) ADJUSTABLE FIN SYSTEM

(76) Inventors: Quint J. Higgins, Raleigh, NC (US); Kenneth W. Briel, Smithfield, NC (US)

( * ) Notice: Subject to any disclaimer, the term of this patent is extended or adjusted under 35 U.S.C. 154(b) by 280 days.

(21) Appl. No.: 13/540,785

(22) Filed: Jul. 3, 2012

(65) Prior Publication Data

US 2013/0012084 A1 Jan. 10, 2013

Related U.S. Application Data

(60) Provisional application No. 61/505,366, filed on Jul. 7, 2011.

(51) Int. Cl.
*B63B 1/00* (2006.01)
*B63B 35/00* (2006.01)
*B63B 35/79* (2006.01)

(52) U.S. Cl.
CPC ..... *B63B 35/793* (2013.01)
USPC ..... 441/79

(58) Field of Classification Search
CPC ..... B63B 39/06; B63B 2035/79; B63B 2035/7903; B63B 2035/81; B63B 2035/813; B63B 2039/00; B63B 2039/06; B63B 2039/65; B63B 2041/00
USPC ..... 114/39.15; 441/65, 68, 74, 76, 79
See application file for complete search history.

(56) References Cited

U.S. PATENT DOCUMENTS

| | | | | |
|---|---|---|---|---|
| 4,439,166 | A | 3/1984 | Maxwell | |
| 5,299,963 | A | 4/1994 | Isensee | |
| 5,493,989 | A | 2/1996 | Anderson | |
| 5,503,581 | A | 4/1996 | McCullough | |
| 6,213,044 | B1 | 4/2001 | Rodgers | |
| 6,244,921 | B1 | 6/2001 | Pope | |
| 6,793,548 | B2 | 9/2004 | Jolly | |
| 6,991,504 | B1 | 1/2006 | English | |
| 7,198,532 | B2 | 4/2007 | Field | |
| 7,285,031 | B2 | 10/2007 | Mair | |
| 7,311,576 | B2 | 12/2007 | Pope | |
| 7,481,690 | B2 | 1/2009 | Shibata | |
| 7,497,752 | B2 | 3/2009 | Field | |
| 2008/0220672 | A1 * | 9/2008 | Koelling et al. | 441/79 |
| 2010/0273373 | A1 | 10/2010 | Field | |

FOREIGN PATENT DOCUMENTS

| | | |
|---|---|---|
| FR | 2659931 | 9/1991 |

* cited by examiner

*Primary Examiner* — Daniel V Venne
(74) *Attorney, Agent, or Firm* — Michael A. Blake

(57) ABSTRACT

An adjustable fin system comprising: a plug assembly, the plug assembly comprising: a plug housing, the plug housing comprising: a closed end; an open end; a plug first set-screw hole; a plug second set-screw hole; a cylinder configured to be rotatable within the plug housing, and installable into the plug housing via the open end, the cylinder comprising: a cylinder first set screw hole; a cylinder second set screw hole; a cap configured to generally close the open end of the plug housing and to restrain the cylinder from leaving the plug housing; a fin removably attachable to the cylinder; where when the plug first set-screw hole is aligned with the cylinder first set screw hole, the fin is at a first fin cant; where when the plug second set-screw hole is aligned with the cylinder second set screw hole, the fin is at a second fin cant.

9 Claims, 4 Drawing Sheets

ADJUSTABLE FIN SYSTEM

CROSS-REFERENCES

This patent application claims the benefit of provisional patent application Ser. No. 61/505,366 by Quint Higgins, entitled "Surfboard Assembly with Adjustable Fin Degreeing Cylinder Plug", filed on Jul. 7, 2011, the entire contents of which are fully incorporated by reference herein.

TECHNICAL FIELD

This invention relates to a fin attachment structure for surfboards or other water craft such as sailboards and boats, and more specifically, to an improved fin attachment structure that allows the roll angle alignment of the fin to be adjusted.

BACKGROUND

Surfing is a popular sport in many parts of the world. Surfing generally involves a surfer riding a wave while upright on a surfboard. The surfer is able to control the surfboard by positioning himself at different locations on the surfboard and by varying his center of gravity. The surfboard (and other types of watercraft) typically has one or more fins or skegs located on the underside of the surfboard. These fins are designed to guide and steer the surfboard through the water. Many surfboards are designed and manufactured such that the fins are fixed in place and cannot be adjusted.

One drawback to the fixed fin configuration of conventional surfboards is that oftentimes a surfer will want to customize a surfboard to achieve desired surfing characteristics. The most direct way to "fine tune" or customize their surfboard is by adjusting the fins. Adjustment of the fins fine tunes the performance of the surfboard to achieve a desired customization. However, the fixed configuration of conventional fins prevents a surfer from adjusting the fins to correct or vary surfboard characteristics.

Depending on the shapes of the waves, a surfer may select a surfboard with fins set at a particular roll angle, or fin cant, relative to the perpendicular axis of the surface of the surfboard. A surfer may carry multiple surfboards of different fin cants which is cumbersome. Known surfboards with adjustable fin cant may have many external parts, and may require a surfer to carry multiple external parts and tools to set the fin cant, which is also cumbersome.

One way that has been tried to overcome this problem is to set a roll angle of the fins to a preset position during the manufacturing process. The roll angle is the angular displacement of the fin relative to the perpendicular axis of the surface of the surfboard. By adjusting the roll angle of the fins, the surfer can obtain at least some of the desired performance characteristics from the surfboard. In theory, the surfer sets forth the surfing characteristics desired from the surfboard, the manufacturer adjusts the fin roll angle to achieve the desired performance, and the fins are fixed into the desired position. In practice, however, a desired fin alignment is difficult to keep during the manufacturing process. Even if the roll angle is as desired when the fin is first mounted, this angle may shift as the manufacturing process progresses. Properly aligning the roll angle of the fins is even more difficult when there are multiple fins. For example, the roll angle of multiple fins (such as a side-by-side configuration) typically must be aligned with respect to each other. Since the fins are fixed, any misalignment in roll angle cannot be corrected and a mistake in aligning even one of the fins may ruin the entire surfboard.

Thus there is a need for an adjustable fin system that will overcome the above listed and other disadvantages.

SUMMARY

The disclosed invention relates to an adjustable fin system, the system comprising: a plug assembly, the plug assembly comprising: a plug housing, the plug housing comprising: a plug housing closed end; a plug housing open end; a plug first set-screw hole; a plug second set-screw hole; a cylinder configured to be rotatable within the plug housing, and installable into the plug housing via the open end, the cylinder comprising: a cylinder first set screw hole; a cylinder second set screw hole; a cap configured to generally close the open end of the plug housing and to restrain the cylinder from leaving the plug housing; a fin removably attachable to the cylinder; where when the plug first set-screw hole is aligned with the cylinder first set screw hole and held in place with respect to each other, the fin is at a first fin cant; where when the plug second set-screw hole is aligned with the cylinder second set screw hole and held in place with respect to each other, the fin is at a second fin cant.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
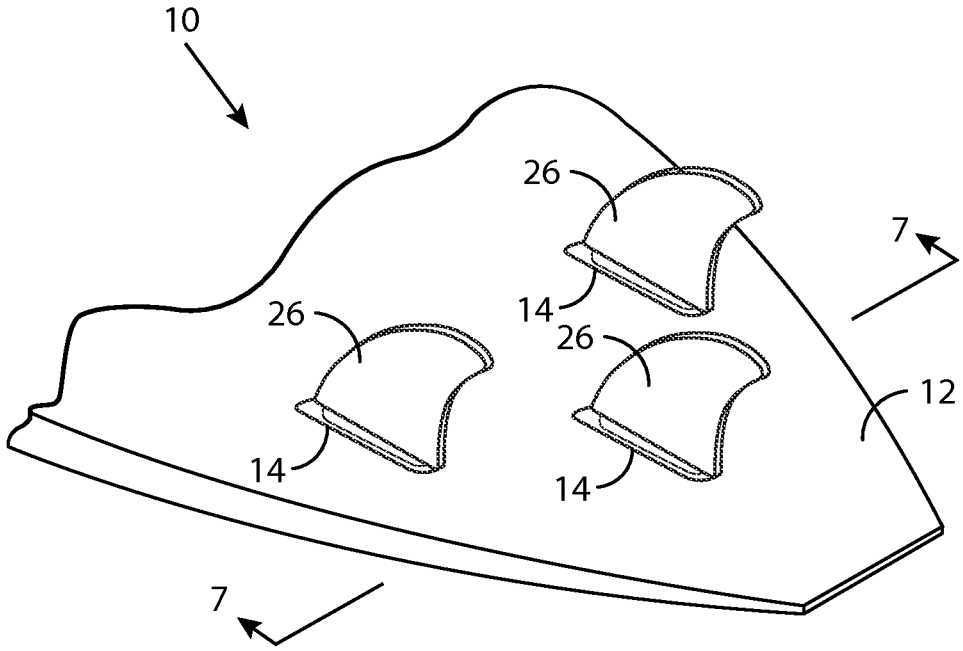
FIG. 1 is a perspective view of a bottom of a surfboard with three adjustable fin systems installed.
Figure 2:
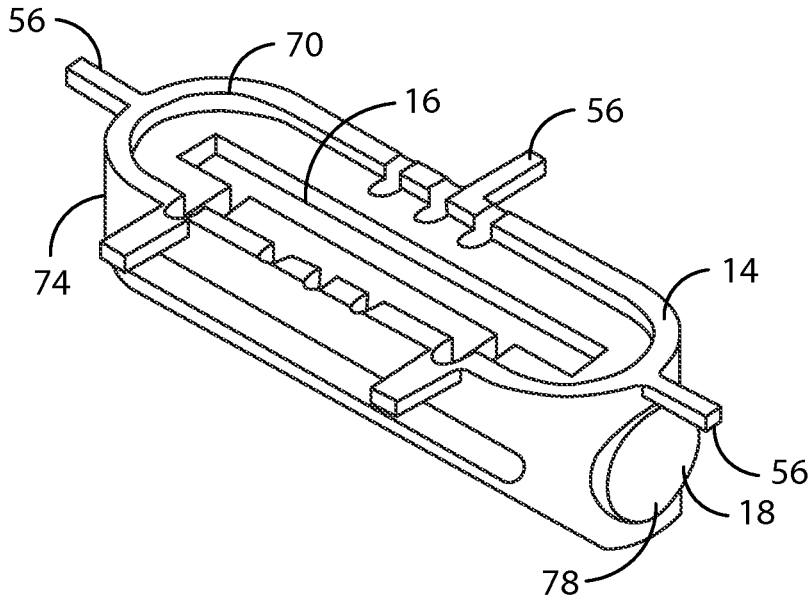
FIG. 2 is a close up perspective view of a plug assembly.

The disclosed system comprises an assembly configured to adjust fin cants on surfboards or other water devices using fins. A surfboard assembly with adjustable fin cant of the present invention has adjustable fin parts self-contained within a surfboard. A surfer may adjust the fin cant quickly and easily with minimal number of tools. Referring now to the figures, wherein the drawings are for purposes of illustrating embodiments of the present disclosure only, and not for purposes of limiting the same, FIG. 1 shows the adjustable fin system 10 installed on a surfboard 12 having one or more fins 26 attached by one or more plug assemblies 14 to the surfboard 12, according to one embodiment of the present disclosure. FIG. 2 is a close up view of the plug assembly 14. The plug assembly 14 allows for a cylinder located within the plug assembly housing 70 to be rotated within the plug assembly housing 70. The plug assembly housing 70 may have a closed end 74 and an open end 78. A cylinder 16 (not shown in this figure) is configured to fit into the open end 78 of plug assembly housing 14 and is generally capable of rotating freely inside plug assembly housing. A cap 18 may be configured to secure the cylinder 16 inside of the plug assembly housing 14 and generally close the open end 78 of the plug assembly housing 14. The plug assembly housing 14 may have one or more alignment arms 56 extending generally orthogonally from the plug assembly housing 14. The alignment arms 56 assist in the proper positioning and installation of the plug assembly housing 14 into a watercraft, such as, but not limited to a surfboard.

Figure 3:
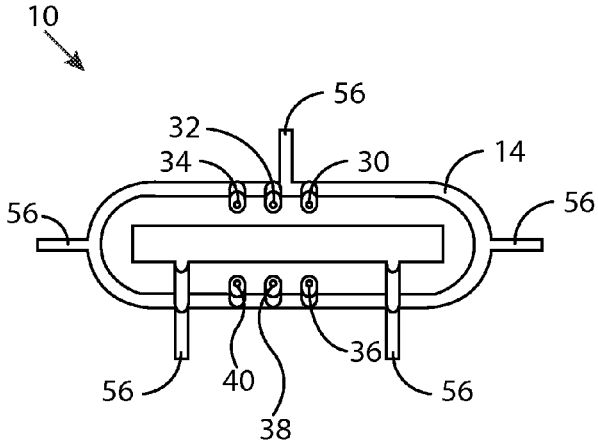
FIG. 3 is a top view of the plug assembly.

FIG. 3 is a top view of a plug assembly housing 14. Plug assembly housing 14 may have a plug first set-screw hole 30, a plug second set-screw hole 32, a plug third set-screw hole 34, a plug fourth set-screw hole 36, a plug fifth set-screw hole 38, and a plug sixth set-screw hole 40. In one embodiment, the plug set-screw holes may be associated with various fin angles as shown below:

| | |
|---|---|
| plug first set-screw hole 30 | 0° fin cant |
| plug second set-screw hole 32 | 3° fin cant |
| plug third set-screw hole 34 | 5° fin cant |
| plug fourth set-screw hole 36 | 7° fin cant |
| plug fifth set-screw hole 38 | 9° fin cant |
| plug sixth set-screw hole 40 | 12° fin cant |

It should be noted that in other embodiments, the plug set-screw holes may be associated with other defined fin cants, depending on the manufacturer's preferences.

Figure 4:
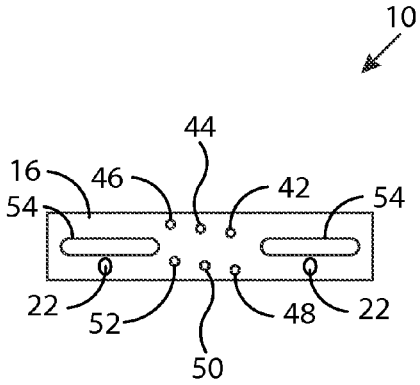
FIG. 4 is a top view of the cylinder.

FIG. 4 is a top view of the cylinder 16 according to one embodiment of the present invention. Cylinder 16 may have fin slots 54 to accommodate fins 26 (not shown in this view), and several set-screw holes. In this embodiment, the cylinder 16 has a cylinder first set screw hole 42, a cylinder second set-screw hole 44, a cylinder third set-screw hole 46, a cylinder fourth set-screw hole 48, a cylinder fifth set-screw hole 50, and a cylinder sixth set-screw hole 52. In one embodiment, the cylinder set-screw holes may be associated with various fin cants as shown below:

| | |
|---|---|
| cylinder first set-screw hole 42 | 0° fin cant |
| cylinder second set-screw hole 44 | 3° fin cant |
| cylinder third set-screw hole 46 | 5° fin cant |
| cylinder fourth set-screw hole 48 | 7° fin cant |
| cylinder fifth set-screw hole 50 | 9° fin cant |
| cylinder sixth set-screw hole 52 | 12° fin cant |

It should be noted that in other embodiments, the cylinder set-screw holes may be associated with other defined fin angles, depending on the manufacturer's preferences.

Figure 5:
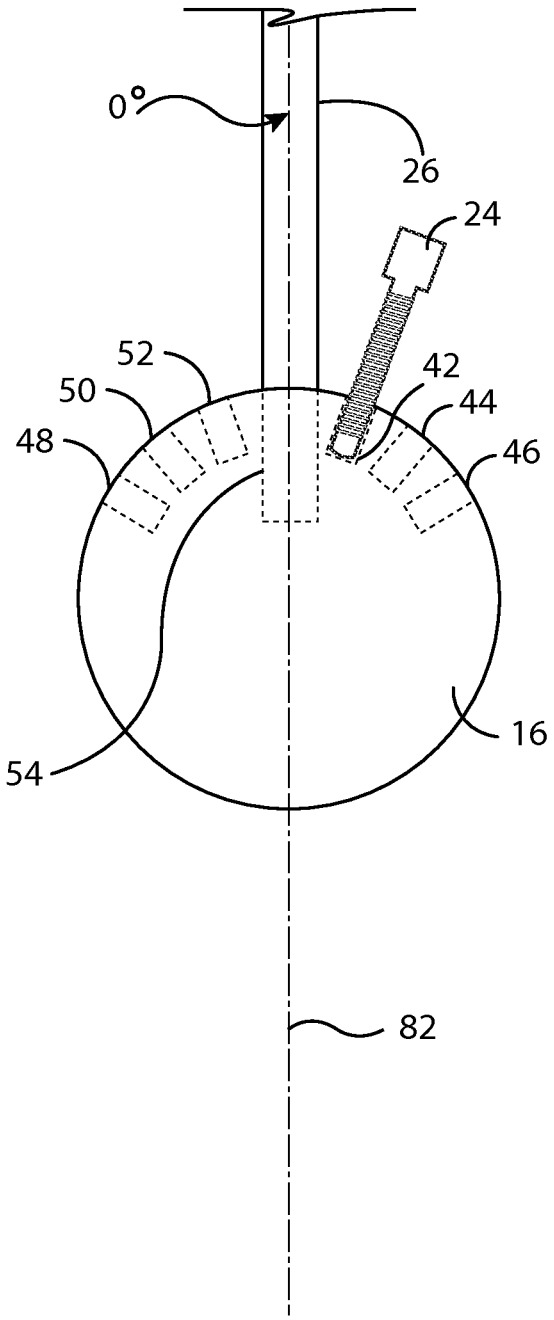
FIG. 5 is a generally cross-sectional view through the longitudinal axis of the cylinder.

FIG. 5 is side view of the cylinder 16 showing one embodiment of the relationship of the cylinder set-screw holes 42, 44, 46, 48, 50, 52 with respect to each other an installed fin 26. A line 82 orthogonal to the bottom surface of the surfboard is shown. When the cylinder angle set screw 24 is installed in the plug first set-screw hole 30 associated with the 0° fin angle (hole 30 and plug assembly not shown in this Figure) and the cylinder first set-screw hole 42 associated with the 0° fin angle, then the angle between the fin and the line 82 is 0°. If the cylinder angle set screw 24 is removed, and the cylinder 16 and fin 26 are rotated counterclockwise so that the cylinder angle set screw 24 is installed in the plug second set-screw hole 32 associated with the 3° fin angle (hole 32 and plug assembly not shown in this Figure) and the cylinder second set-screw hole 44 associated with the 3° fin angle, then the angle between the fin and the line 82 is 3°. Likewise, the cylinder can be rotated even further clockwise so that the set screw 24 is installed at cylinder third set-screw hole 46 and plug third set-screw hole 34, so that the fin will be at an angle of 5°. Likewise with cylinder set-screw holes 48, 50, 52 the fin angle can be adjusted to 7°, 9°, and 12° respectively. Please note that the figures are not generally to scale, and in this figure especially, the angle relationship between the cylinder set-screw holes have been exaggerated to illustrate how the fin angle may be changed simply by rotating the cylinder 16 and installing the set-screw 24 in the proper holes. In one embodiment, cylinder second set-screw hole 44 is 3° to the right of cylinder first set-screw hole 42, cylinder third set-screw hole 46 is 5° to the right of cylinder first set-screw hole 42, cylinder third set-screw hole 46 is 5° to the right of cylinder first set-screw hole 42, cylinder fifth set-screw hole 50 is 2° to the right of cylinder fourth set-screw hole 48, and cylinder sixth set-screw hole 52 is 5° to the right of cylinder fourth set-screw hole 48. In this same embodiment the plug set-screw holes 30, 32, 34 may all be at generally the same angle with respect to the center of the cylinder 16, and the plug set-screw holes 36, 38, 40 may all be at generally the same angle with respect to the center of the cylinder 16. However, one of ordinary skill will recognize that the plug set-screw holes 30, 32, 34, 36, 38, 40 may all be at different angles, just so long as when the proper holes (a plug set—screw hole aligned with a cylinder set-screw hole) are aligned one has the desired fin cant.

Figure 6:
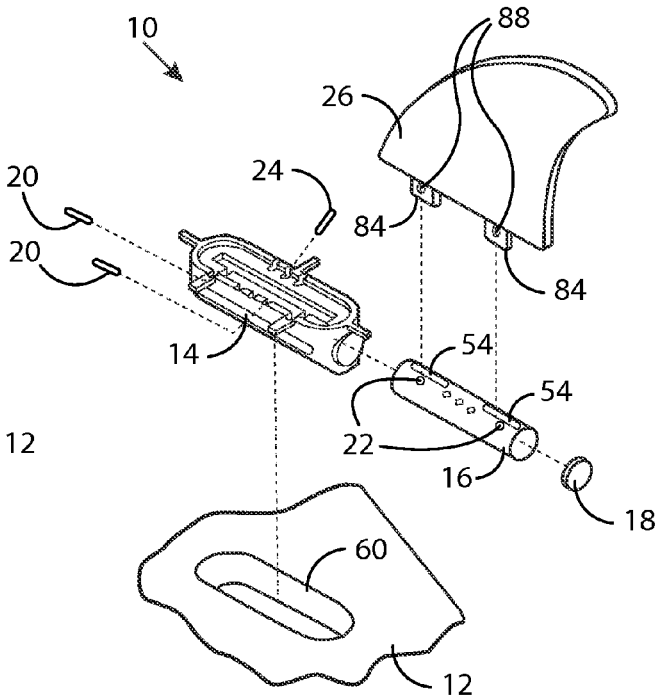
FIG. 6 is an exploded view of the adjustable fin system.

Referring to FIG. 6, cylinder 16 may be secured to plug assembly 14 by cap 18 at the open end 78 of the plug assembly 14. Fin 26 may have one or more fin tabs 84, and the fin tabs 84 may each have a fin tab hole 88. The fin may be secured to cylinder 16 via one or more fin slots 54 by fin set-screws 20 through fin set-screws holes 22 and fin tab holes 88. The plug assembly 14 is configured to be attached to the bottom surface of a surfboard 12 via a plug assembly hole 60.

Figure 7:
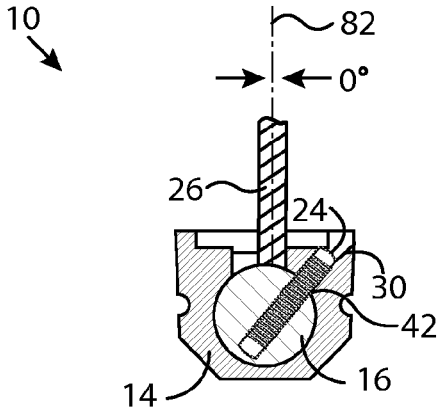
FIGS. 7-12 are cross-sectional views of the plug assembly.

FIGS. 7-12 are section views generally along line 7-7 in FIG. 1, and more specifically through the respective plug set-screw hole 30, 32, 34, 36, 38, 40. FIG. 7 shows the section view at the plug first set-screw hole 30. The fin angle makes a 0° angle with a line 82 that is generally orthogonal to the bottom surface of the surfboard 12, thus the fin cant is 0°. FIG. 7 shows a cylinder angle set screw 24 threaded into the plug first set-screw hole 30 and the cylinder first set screw hole 42. In this configuration, the fin cant is 0°.

Figure 8:
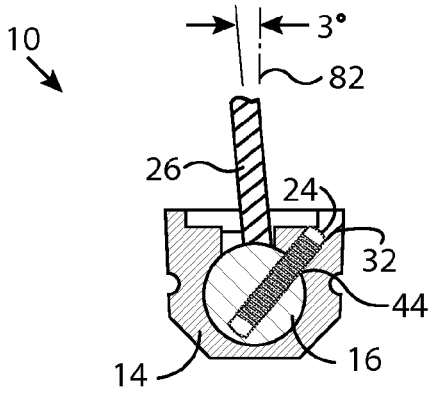

FIG. 8 shows the section view at the plug second set-screw hole 32. The fin cant is 3°, as shown by the fin making a 3° angle with the line 82. The cylinder angle set screw 24 is threaded into the plug second set-screw hole 32 and the cylinder second set screw hole 44.

Figure 9:
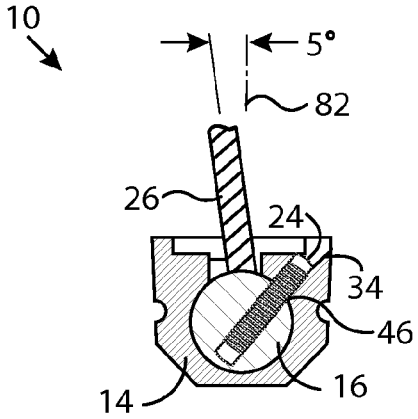

FIG. 9 shows the section view at the plug third set-screw hole 34. The fin cant is 5°, as shown by the fin making a 5° angle with the line 82. The cylinder angle set screw 24 is threaded into the plug third set-screw hole 34 and the cylinder third set screw hole 46.

Figure 10:
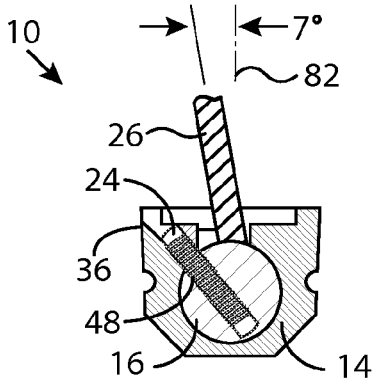

FIG. 10 shows the section view at the plug fourth set-screw hole 36. The fin cant is 7°, as shown by the fin making a 7° angle with the line 82. The cylinder angle set screw 24 is threaded into the plug fourth set-screw hole 36 and the cylinder fourth set screw hole 48.

Figure 11:
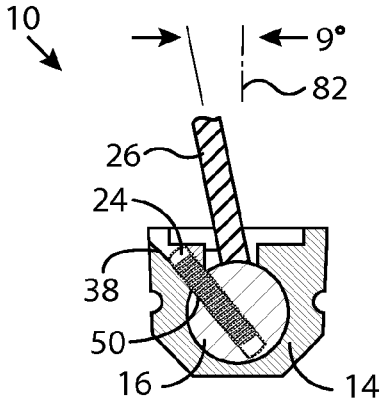

FIG. 11 shows the section view at the plug fifth set-screw hole 38. The fin cant is 9°, as shown by the fin making a 9° angle with the line 82. The cylinder angle set screw 24 is threaded into the plug fifth set-screw hole 38 and the cylinder fifth set screw hole 50.

Figure 12:
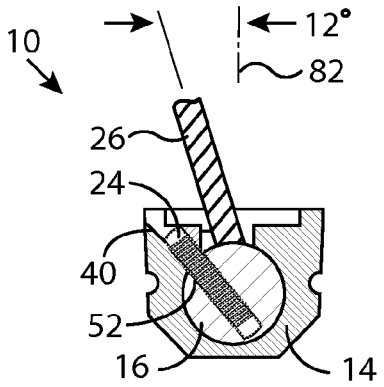

FIG. 12 shows the section view at the plug sixth set-screw hole 40. The fin cant is 12°, as shown by the fin making a 12° angle with the line 82. The cylinder angle set screw 24 is threaded into the plug sixth set-screw hole 40 and the cylinder sixth set screw hole 52.

Figure 13:
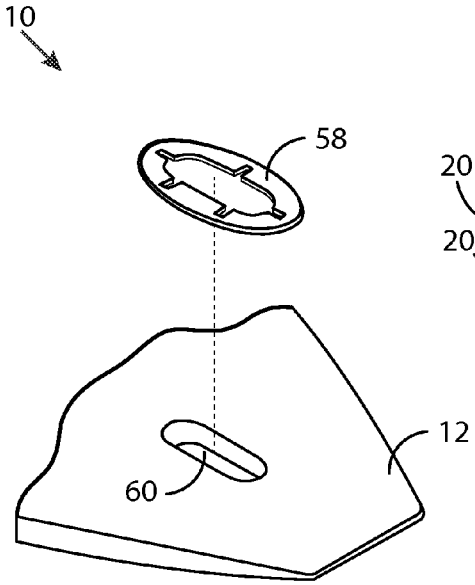
FIG. 13 is a view of the surfboard notch.

FIG. 13 is an exploded view illustrating how a template 58 may be positioned over a surfboard notch 60 in order to position plug assembly 14 in the bottom surface of the surfboard 12 (or other water craft) during installation of adjustable fin system 10 onto the surfboard 12, according to one embodiment of the present invention.

According to one embodiment of the present disclosure, adjusting the fin cant may be achieved by rotating the fin 26 while the fin is attached to the cylinder 16 to a desired angle, aligning one of the cylinder set screw hole 42, 44, 46, 48, 50, 52 with the corresponding plug set-screw hole 30, 32, 34, 36, 38, 40, and then threading cylinder angle set screw 24 into the cylinder set screw hole and the plug set-screw hole. It may not be necessary to remove the fin to adjust fin cant, according to one embodiment of the present invention.

Plug assembly 14 may be made of any suitable material, such as but not limited to wood, metal, and plastic. Plug assembly 14 may be generally rectangular shaped with rounded or oval ends. Alternatively, plug assembly 14 may be generally shaped as a circle, an elongated circle, a square, a rectangle, or two circles attached to each other. Plug assembly 14 may be sized to accommodate a fin for a surfboard or any other water craft using a fin. Plug assembly 14 may be sized to accommodate cylinder 16, and may allow cylinder 16 rotate freely.

This invention has many advantages. The invention allows one to change the cant of the fin. The invention allows one to change the fin cant to one of many fin cant angles, with the use of only one tool (an allen wrench in one example) and the use of one set screw. The fin cant can be changed without removing or adjusting additional mechanical parts (other than simply moving the set screw from one pair of holes, rotating the fin to the desired cant, and reinstalling the set screw into another pair of holes). The fin cant may be changed when the water craft is still in the water.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. An adjustable fin system, the system comprising:
a plug assembly, the plug assembly comprising:
a plug housing, the plug housing comprising:
a plug housing closed end;
a plug housing open end;
a plug first set-screw hole;
a plug second set-screw hole
a cylinder configured to be rotatable within the plug housing, and installable into the plug housing via the open end, the cylinder comprising:
a cylinder first set screw hole;
a cylinder second set screw hole;
a cap configured to generally close the open end of the plug housing and to restrain the cylinder from leaving the plug housing;
a fin removably attachable to the cylinder;
wherein when the plug first set-screw hole is aligned with the cylinder first set screw hole and held in place with respect to each other, the fin is at a first fin cant;
wherein when the plug second set-screw hole is aligned with the cylinder second set screw hole and held in place with respect to each other, the fin is at a second fin cant.

2. The adjustable fin system of claim 1, wherein the first fin cant is about 0°.

3. The adjustable fin system of claim 1, where the second fin cant is about 3°.

4. The adjustable fin system of claim 1,
where the plug housing further comprises:
a plug third set-screw hole;
a plug fourth set-screw hole;
where the cylinder further comprises:
a cylinder third set screw hole;
a cylinder fourth set screw hole;
wherein when the plug third set-screw hole is aligned with the cylinder third set screw hole and held in place with respect to each other, the fin is at a third fin cant;
wherein when the plug fourth set-screw hole is aligned with the cylinder fourth set screw hole and held in place with respect to each other, the fin is at a fourth fin cant.

5. The adjustable fin system of claim 4, wherein the first fin cant is about 0°, the second fin cant is about 3°, the third fin cant is about 5°, and the fourth fin cant is about 7°.

6. The adjustable fin system of claim 4,
where the plug housing further comprises:
a plug fifth set-screw hole;
a plug sixth set-screw hole;
where the cylinder further comprises:
a cylinder fifth set screw hole;
a cylinder sixth set screw hole;
wherein when the plug fifth set-screw hole is aligned with the cylinder fifth set screw hole and held in place with respect to each other, the fin is at a fifth fin cant;
wherein when the plug sixth set-screw hole is aligned with the cylinder sixth set screw hole and held in place with respect to each other, the fin is at a sixth fin cant.

7. The adjustable fin system of claim 6, wherein the first fin cant is about 0°, the second fin cant is about 3°, the third fin cant is about 5°, the fourth fin cant is about 7°, the fifth fin cant is about 9°, and the sixth fin cant is about 12°.

8. The adjustable fin system of claim 1,
wherein when the plug first set-screw hole is aligned with the cylinder first set screw hole and held in place with respect to each other, the two holes are held in place by a set screw threaded into both the plug first set-screw hole and the cylinder first set screw hole; and
wherein when the plug second set-screw hole is aligned with the cylinder second set screw hole and held in place with respect to each other, the two holes are held in place by a set screw threaded into both the plug second set-screw hole and the cylinder second set screw hole.

9. The adjustable fin system of claim 1, further comprising:
a surfboard, the surfboard comprising a surfboard notch configured to house a plug assembly.

* * * * *